US008888243B2

(12) United States Patent
Hong et al.

(10) Patent No.: US 8,888,243 B2
(45) Date of Patent: Nov. 18, 2014

(54) INKJET PRINTING DEVICES FOR REDUCING DAMAGE DURING NOZZLE MAINTENANCE

(71) Applicant: Samsung Electronics Co., Ltd., Suwon-si (KR)

(72) Inventors: Young-ki Hong, Anyang-si (KR); Sung-gyu Kang, Suwon-si (KR); Joong-hyuk Kim, Seoul (KR); Seung-ho Lee, Suwon-si (KR); Jin-Seok Hong, Seoul (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 0 days.

(21) Appl. No.: 13/847,154

(22) Filed: Mar. 19, 2013

(65) Prior Publication Data

US 2014/0098160 A1 Apr. 10, 2014

(30) Foreign Application Priority Data

Oct. 9, 2012 (KR) ..... 10-2012-0112096

(51) Int. Cl.

*B41J 2/135* (2006.01)
*B41J 2/16* (2006.01)
*B41J 2/14* (2006.01)

(52) U.S. Cl.

CPC .... *B41J 2/14314* (2013.01); *B41J 2002/14475* (2013.01); *B41J 2/14233* (2013.01); *B41J 2202/11* (2013.01); *B41J 2/1606* (2013.01); *B41J 2/1631* (2013.01); *B41J 2/1629* (2013.01); *B41J 2/162* (2013.01); *B41J 2/1433* (2013.01)

USPC ..... 347/44; 347/47

(58) Field of Classification Search

CPC ..... B41J 2/16; B41J 2/1412; B41J 2/14129; B41J 2/1423; B41J 2/1433; B41J 2/1603; B41J 2/04526; B41J 2/14

See application file for complete search history.

(56) References Cited

U.S. PATENT DOCUMENTS

| | | | | |
|---|---|---|---|---|
| 4,007,464 A * | 2/1977 | Bassous et al. | ..... | 347/47 |
| 4,282,533 A | 8/1981 | Brooks et al. | | |
| 5,949,454 A * | 9/1999 | Nozawa et al. | ..... | 347/45 |
| 7,862,160 B2 | 1/2011 | Andrews et al. | | |

FOREIGN PATENT DOCUMENTS

| | | |
|---|---|---|
| KR | 10-2007-0040395 A | 4/2007 |
| KR | 10-2008-0073129 A | 8/2008 |
| KR | 10-0948954 B1 | 3/2010 |
| KR | 10-2010-0043392 A | 4/2010 |
| KR | 20110065099 A | 6/2011 |
| KR | 10-1113607 B1 | 2/2012 |

* cited by examiner

*Primary Examiner* — Juanita D Jackson

(74) *Attorney, Agent, or Firm* — Harness, Dickey & Pierce, P.L.C.

(57) ABSTRACT

Provided is an inkjet printing device. The inkjet printing device includes a passage forming substrate having a plurality of pressure chambers and a nozzle substrate. The nozzle substrate includes a plurality of nozzle blocks extending in a first direction, a plurality of nozzles connected to the pressure chambers and penetrating the nozzle blocks, and a plurality of trenches. Each of the trenches is disposed in a second direction perpendicular to the first direction with respect to the nozzle blocks, recessed from a bottom surface of the nozzle blocks, and extends in the first direction.

17 Claims, 11 Drawing Sheets

INKJET PRINTING DEVICES FOR REDUCING DAMAGE DURING NOZZLE MAINTENANCE

CROSS-REFERENCE TO RELATED APPLICATION

This application claims the benefit of Korean Patent Application No. 10-2012-0112096, filed on Oct. 9, 2012 in the Korean Intellectual Property Office, the disclosure of which is incorporated herein in its entirety by reference.

BACKGROUND

1. Field

At least one example embodiment relates to inkjet printing devices.

2. Description of the Related Art

Inkjet printing devices eject fine droplets of ink onto desired positions on printing media in order to print predetermined images.

Inkjet printing devices are classified into piezoelectric inkjet printing devices and electrostatic inkjet printing devices according to an ink ejection method. Piezoelectric inkjet printing devices eject ink by deforming a piezoelectric material while the electrostatic inkjet printing devices eject ink by an electrostatic force. Electrostatic inkjet printing devices may use two methods to eject droplets: 1) an electrostatic induction ejection method in which ink droplets are ejected by electrostatic induction; or 2) a method in which ink droplets are ejected after charged pigments are accumulated by an electrostatic force.

SUMMARY

At least one example embodiment provides inkjet printing devices designed to reduce the risk of damage to a nozzle during maintenance At least one example embodiment provides inkjet printing devices designed to allow ejection of fine droplets, thereby achieving high precision printing.

Additional aspects will be set forth in part in the description which follows and, in part, will be apparent from the description, or may be learned by practice of the presented embodiments.

According to at least one example embodiment, an inkjet printing device includes a passage forming substrate having a plurality of pressure chambers and a nozzle substrate. The nozzle substrate includes a plurality of nozzle blocks extending in a first direction, a plurality of nozzles connected to the pressure chambers and penetrating the nozzle blocks, and a plurality of trenches. Each of the trenches is disposed in a second direction perpendicular to the first direction with respect to the nozzle blocks, recessed from a bottom surface of the nozzle blocks, and extends in the first direction.

According to at least one example embodiment, the nozzles have a tapered shape such that a cross-sectional area of the nozzles decreases from a top surface of the nozzle substrate toward a bottom surface of the nozzle substrate.

According to at least one example embodiment, a wall of each of the nozzles in the first direction is inclined at an acute angle with respect to a direction along which the nozzles penetrates the nozzle blocks.

According to at least one example embodiment, the nozzles have one of a polypyramid shape and a cone shape.

According to at least one example embodiment, the nozzles have a quadrangular pyramid shape.

According to at least one example embodiment, the nozzle substrate is a single crystal silicon (Si) substrate.

According to at least one example embodiment, a wall of each of the nozzles in the second direction is formed of silicon dioxide ($SiO_2$).

According to at least one example embodiment, a wall of each of the nozzles in the first direction is formed of a $SiO_2$-Si hybrid material.

According to at least one example embodiment, the inkjet printing device further includes a piezoelectric actuator configured to provide a pressure change for ejecting ink within the pressure chamber and an electrostatic actuator configured to provide an electrostatic driving force to ink within the nozzle.

According to at least one example embodiment, an inkjet printing device includes a passage forming substrate having a plurality of pressure chambers, a nozzle substrate including a plurality of nozzles, and an actuator configured to provide a driving force for ejecting ink through the nozzles. Each of the nozzles has an opening through which ink within the pressure chamber is ejected. A wall of each of the nozzles in a first direction is thicker than a wall of each of the nozzles in a second direction perpendicular to the first direction.

According to at least one example embodiment, the nozzle substrate includes a plurality of nozzle blocks, each nozzle block extending in the first direction and including the plurality of nozzles, and a plurality of trenches. Each trench is disposed in the second direction perpendicular to the first direction with respect to the nozzle blocks and recessed from a bottom surface of the nozzle blocks.

According to at least one example embodiment, the nozzle blocks include the plurality of nozzles arranged in the first direction.

According to at least one example embodiment, the wall of each of the nozzles in the first direction forms a boundary between the nozzle blocks and the trenches.

According to at least one example embodiment, the nozzles have a tapered shape such that a cross-sectional area of the nozzles decreases from a top surface of the nozzle blocks toward the bottom surface of the nozzle blocks.

According to at least one example embodiment, the wall of each of the nozzles in the first direction is inclined at an acute angle with respect to a direction along which the nozzles penetrate the nozzle blocks.

According to at least one example embodiment, the nozzles have one of a polypyramid shape and a cone shape.

According to at least one example embodiment, the nozzles have a quadrangular pyramid shape.

According to at least one example embodiment, the actuator includes an electrostatic actuator configured to provide an electrostatic driving force to ink within the nozzles.

According to at least one example embodiment, the actuator further includes a piezoelectric actuator configured to provide a pressure change for ejecting the ink within the pressure chamber.

BRIEF DESCRIPTION OF THE DRAWINGS

These and/or other aspects will become apparent and more readily appreciated from the following description of example embodiments, taken in conjunction with the accompanying drawings in which.

DETAILED DESCRIPTION OF EXAMPLE EMBODIMENTS

Figure 1:
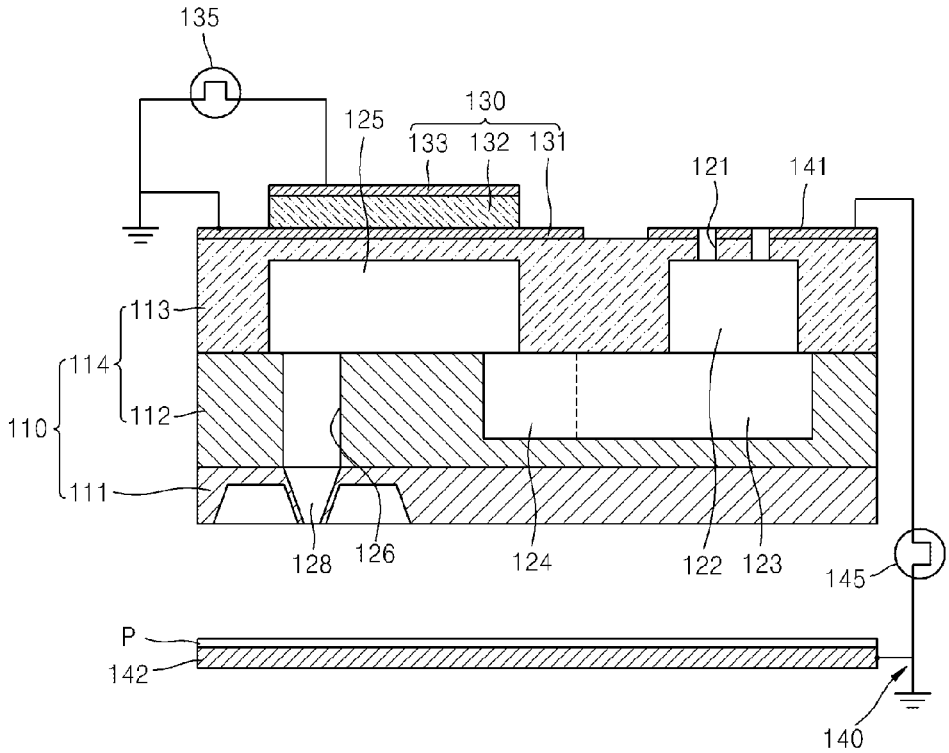
FIG. 1 is a cross-sectional view of an inkjet printing device according to at least one example embodiment.

Example embodiments will be understood more readily by reference to the following detailed description and the accompanying drawings. The example embodiments may, however, be embodied in many different forms and should not be construed as being limited to those set forth herein. Rather, these example embodiments are provided so that this disclosure will be thorough and complete. In at least some example embodiments, well-known device structures and well-known technologies will not be specifically described in order to avoid ambiguous interpretation.

It will be understood that when an element is referred to as being "connected to" or "coupled to" another element, it can be directly on, connected or coupled to the other element or intervening elements may be present. In contrast, when an element is referred to as being "directly connected to" or "directly coupled to" another element, there are no intervening elements present. Like numbers refer to like elements throughout. As used herein, the term "and/or" includes any and all combinations of one or more of the associated listed items.

It will be understood that, although the terms first, second, third, etc., may be used herein to describe various elements, components and/or sections, these elements, components and/or sections should not be limited by these terms. These terms are only used to distinguish one element, component or section from another element, component or section. Thus, a first element, component or section discussed below could be termed a second element, component or section without departing from the teachings of the example embodiments.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises," "comprising," "includes," and/or "including" when used in this specification, specify the presence of stated components, steps, operations, and/or elements, but do not preclude the presence or addition of one or more other components, steps, operations, elements, and/or groups thereof.

Unless otherwise defined, all terms (including technical and scientific terms) used herein have the same meaning as commonly understood by one of ordinary skill in the art to which these example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Spatially relative terms, such as "below", "beneath", "lower", "above", "upper", and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Reference will now be made in detail to embodiments, examples of which are illustrated in the accompanying drawings, wherein like reference numerals refer to the like elements throughout. In the drawings, the dimensions and thicknesses of layers and regions may be exaggerated for clarity. In this regard, example embodiments may have different forms and should not be construed as being limited to the descriptions set forth herein. Accordingly, example embodiments are merely described below, by referring to the figures, to explain aspects of the present description.

FIG. 1 illustrates a configuration of an inkjet printing device according to at least one example embodiment. Referring to FIG. 1, the inkjet printing device includes a fluid path plate 110 and an actuator that provides a driving force for ejecting ink. The actuator employed in the inkjet printing device of FIG. 1 is a hybrid type actuator including a piezoelectric actuator 130 for providing a piezoelectric driving force and an electrostatic actuator 140 for providing an electrostatic driving force.

A fluid path plate 110 may include an ink passage and a plurality of nozzles 128 for ejecting ink droplets. The ink passage may include an ink inlet 121 through which ink is introduced and a plurality of pressure chambers 125 containing the introduced ink. The ink inlet 121 may be disposed at an upper surface of the fluid path plate 110 and connected to an ink tank (not shown). Ink supplied from the ink tank flows into the fluid path plate 110 through the ink inlet 121. The plurality of pressure chambers 125 may be formed in the fluid path plate 110 and accommodate the ink supplied through the ink inlet 121. Manifolds 122 and 123 and a restrictor 124 that connect the ink inlet 121 to the plurality of pressure chambers 125 may be formed in the fluid path plate 110. The plurality of nozzles 128 eject ink stored in the plurality of pressure chambers 125 in the form of droplets. Each nozzle may be connected to a corresponding one of the plurality of pressure chambers 125. The plurality of nozzles 128 may be formed on a lower surface of the fluid path plate 110 and arranged in one or more rows. The pressure plate 110 may further include a plurality of dampers 126 connecting the plurality of pressure chambers 125 with the plurality of nozzles 128.

The fluid path plate 110 may be a substrate formed of a material suitable for micro-processing, e.g., a silicon substrate. For example, the fluid path plate 110 may include a passage forming substrate 114 having the ink passage formed therein and a nozzle substrate 111 having the plurality of nozzles 128 formed thereon. The passage forming substrate 114 includes first and second passage forming substrates 113 and 112. The ink inlet 121 may be formed to vertically penetrate the uppermost substrate, i.e., the first passage forming substrate 113, and the plurality of pressure chambers 125 may be formed in the first passage forming substrate 113 to a desired (or alternatively, predetermined) depth from a bottom surface of the first passage forming substrate 113. The plurality of nozzles 128 may be formed to vertically pass through the lowermost substrate, i.e., the second passage forming substrate 112. The manifolds 122 and 123 may be formed in the first and second passage forming substrates 113 and 111, respectively. The plurality of dampers 126 may be formed to vertically pass through the second substrate 112. The sequentially stacked three substrates, i.e., the first and second passage forming substrates 113 and 112 and the nozzle substrate 112, are bonded by Silicon Direct Bonding (SDB). The ink passage formed in the fluid path plate 110 is not limited to the embodiment illustrated in FIG. 1 and may be arranged into different configurations.

The piezoelectric actuator 130 may be disposed at a position on the fluid path plate 110 corresponding to the plurality of pressure chambers 125. The piezoelectric actuator 130 may provide a piezoelectric driving force for ejecting ink, i.e., pressure changes, to the plurality of pressure chambers 125. The piezoelectric actuator 130 may include a lower electrode 131, a piezoelectric layer 132, and an upper electrode 133, all of which are sequentially stacked on an upper surface of the fluid path plate 110. The lower electrode 131 may act as a common electrode, and the upper electrode 133 may function as a driving electrode for applying a voltage to the piezoelectric layer 132. A piezoelectric voltage applying unit 135 applies a piezoelectric driving voltage to the upper electrode 133. The piezoelectric layer 132 is deformed in response to the piezoelectric driving voltage, thereby deforming the first passage forming substrate 113, a part of which forms an upper wall of the pressure chamber 125. The piezoelectric layer 132 may be formed of a desired (or alternatively, predetermined) piezoelectric material such as lead zirconate titanate (PZT) ceramic.

The electrostatic actuator 140 provides an electrostatic driving voltage to ink inside the nozzle 128 and may include first and second electrostatic electrodes 141 and 142 that are disposed to face each other. An electrostatic voltage applying unit 145 applies an electrostatic driving voltage between the first and second electrostatic electrodes 141 and 142.

For example, the first electrostatic electrode 141 may be disposed on the fluid path plate 110, i.e., on the first passage forming substrate 113. In this case, the first electrostatic electrode 141 may be disposed in a region where the ink inlet 121 is formed, so that the first electrostatic electrode 141 is separated from the lower electrode 131 of the piezoelectric actuator 130. The second electrostatic electrode 142 may be separated from a bottom surface of the fluid path plate 110 by a desired (or alternatively, predetermined) distance. A printing medium P on which ink droplets ejected from the nozzles 128 of the fluid path plate 110 are sprayed is disposed on the second electrostatic electrode 142.

The electrostatic voltage applying unit 145 may apply an electrostatic driving voltage in pulse form. Although FIG. 1 shows that the second electrostatic electrode 142 is grounded, the first electrostatic electrode 141 may be grounded. The electrostatic voltage applying unit 145 may apply an electrostatic driving voltage in a direct current (DC) form. In this case, the first or second electrostatic electrode 141 or 142 may be grounded. The first electrostatic electrode 141 may be disposed at a different position than illustrated in FIG. 1. For example, although not shown in FIG. 1, the first electrostatic electrode 141 may be disposed within the fluid path plate 110, e.g., on bottom surfaces of the pressure chamber 125, the restrictor 124, and the manifold 123. However, a position of the first electrostatic electrode 141 is not limited thereto, and may be disposed at different positions within the fluid path plate 110. For example, the first electrostatic electrode 141 may be formed only on a bottom surface of the pressure chamber 125, or on bottom surfaces of the restrictor 124 or manifold 123. Further, the first electrostatic electrode 141 may be formed integrally with the lower electrode 131.

Figure 2:
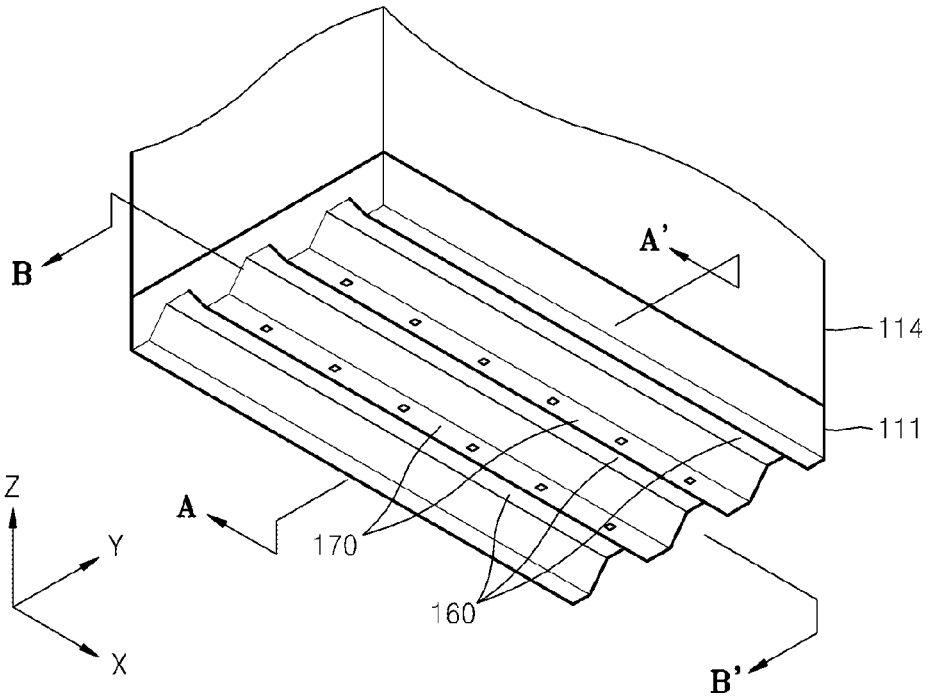
FIG. 2 is a partial bottom perspective view of the inkjet printing device of FIG. 1.

FIG. 2 is a partial bottom perspective view of the inkjet printing device of FIG. 1. Referring to FIG. 2, a plurality of nozzle blocks 170 and a plurality of trenches 160 are shown. Each of the plurality of nozzle blocks 170 extends in a first (X) direction. Each of the trenches 160 is disposed in a second (Y) direction perpendicular to the first (X) direction with respect to the nozzle blocks 170 and extends in the first (X) direction. In this configuration, the nozzle substrate 111 of FIG. 2 shows that the nozzle blocks 170 and the trenches 160 are arranged in an alternating manner in the second (Y) direction. The trenches 160 are disposed on either side of the nozzle block 170 in the second (Y) direction. The plurality of nozzles 128 is formed to penetrate the nozzle block 170 of the nozzle substrate 111.

Figure 3:
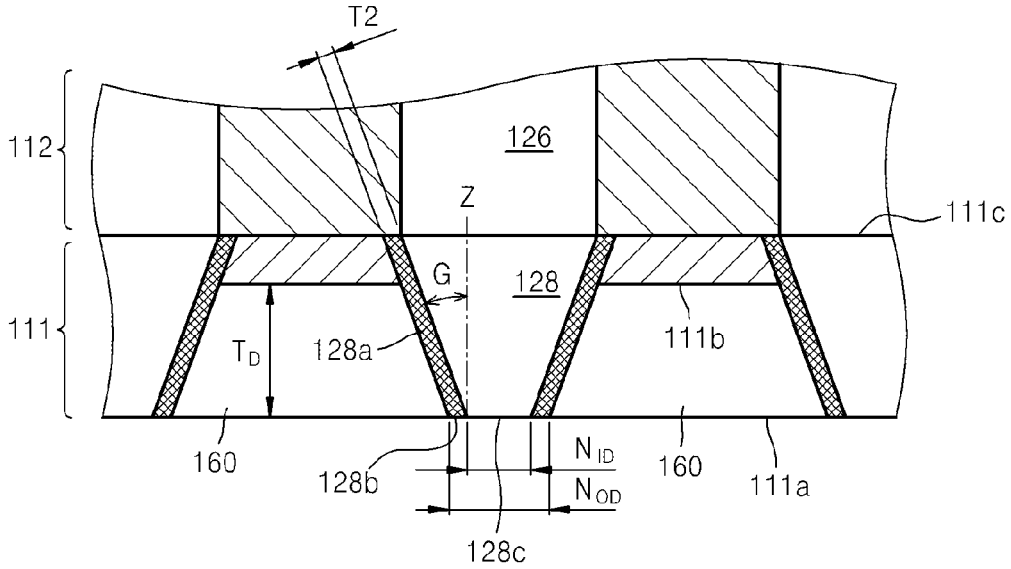
FIG. 3 is a cross-sectional view taken along line A-A' of FIG. 2.
Figure 4:
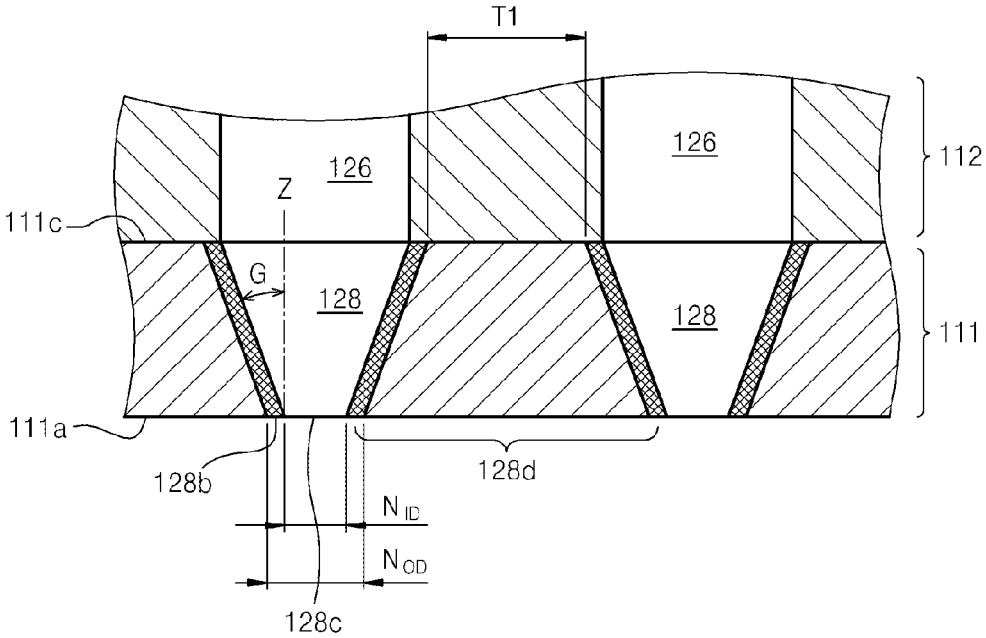
FIG. 4 is a cross-sectional view taken along line B-B' of FIG. 2.

FIG. 3 is a cross-sectional view taken along line A-A' of FIG. 2, and FIG. 4 is a cross-sectional view taken along line B-B' of FIG. 2. Referring to FIGS. 3 and 4, the nozzle 128 is tapered in which a size of a cross-sectional area thereof is reduced from a top surface 111 c of the nozzle substrate 111 toward a bottom surface 111 a of the nozzle substrate 111 (i.e., a lower surface of the fluid path plate 110). The nozzle 128 may have a cone shape with a circular cross-section or a polypyramid shape with a polygonal cross-section. In one embodiment, the nozzles 128 having a quadrangular pyramid shape are formed by anisotropically etching a single crystal silicon substrate, as described below.

When the nozzle 128 has a polygonal cross-section, diameters of the nozzle 128, i.e., inside diameter NID and outside diameter NOD, may be indicated by a diameter of an equivalent circle. This allows realization of an inkjet printing device having a small diameter opening 128*c* of the nozzle 128 so that micro droplets may be ejected. The trenches 160 are recessed from the bottom surface 111*a* of the nozzle substrate 111. As shown in FIG. 2, the trench 160 is located in the second (Y) directional side of the nozzle block 170, and is not formed in the first (X) directional side thereof.

A wall 128*a* of the nozzle 128 may create a boundary in the second (Y) direction between the nozzle substrate 111 and the nozzle 128 as well as a boundary between the nozzle 128 and the trench 160. An angle G at which the wall 128*a* is inclined to a direction Z along which the nozzle 128 penetrates the nozzle block may be an acute angle that is less than 90 degrees. Thus, a cross-section of the nozzle 128 in the second (Y) direction has a tapered shape in which the opening 128*c* extends into the trench 160 toward the bottom surface 111*a*.

Due to the above configuration, the nozzle substrate 111 has a trench surface 111*b* that is recessed from the bottom surface 111 a towards a top surface 111*c* and extends in the first (X) direction. The tapered nozzle 128 penetrates from the top surface 111*c* toward the trench surface 111*b*. The wall 128*a* forms boundaries between the nozzle substrate 111 and the nozzle 128 and between the trench 160 and the nozzle 128, and extends beyond the trench surface 111*b* towards the bottom surface 111*a* while maintaining a tapered shape. An end 128*b* and the opening 128*c* of the nozzle 128 may not protrude beyond the bottom surface 111*a* of the nozzle substrate 111. Of course, the end 128*b* and the opening 128*c* of the nozzle 128 may extend beyond the bottom surface 111*a*.

The wall 128*d* may form a boundary between the plurality of nozzles 128 in the first (X) direction. A thickness T1 of the wall 128*d* is greater than a thickness T2 of the wall 128*a*. When the nozzle 128 is entirely inclined downward, the thickness T1 of the wall 128*d* varies depending on the position along the penetration direction Z of the nozzle 128. In this case, the thickness T1 refers to a minimum thickness of the wall 128*d*, i.e., the thickness T1 corresponds to a distance between the top surfaces 111*c* of two adjacent nozzles 128 (see FIG. 4).

The wall 128*a* may be formed of a different material than the nozzle substrate 111, such as silicon dioxide ($SiO_2$), silicon nitride (SiN), titanium (Ti), platinum (Pt), or nickel (Ni). Alternatively, the wall 128*a* may be formed of the same material as the nozzle substrate 111, such as Si. The wall 128*d* may be formed of a hybrid material in which a different material than that of the nozzle substrate 111, e.g., $SiO_2$, SiN, Ti, Pt, or Ni, and the same material as that of the nozzle substrate 111, e.g., Si are stacked on each other in the first (X) direction. Of course, the wall 128*d* may be formed only of the same material as the nozzle substrate 111.

When ink, and in particular, fine ink droplets, are ejected only by a piezoelectric driving force from the piezoelectric actuator 130, the velocity of the ink droplets may be decreased due to air resistance after the ink droplets escape from the nozzle 128. Furthermore, a path along which the ink droplets fly may be distorted due to the air resistance. According to the hybrid type actuator, an electrostatic driving force generated by the electrostatic actuator 140 accelerates ink droplets. Thus, the ink droplets may reach a desired position on the printing medium P without experiencing distortions in their flight path.

Figure 5:
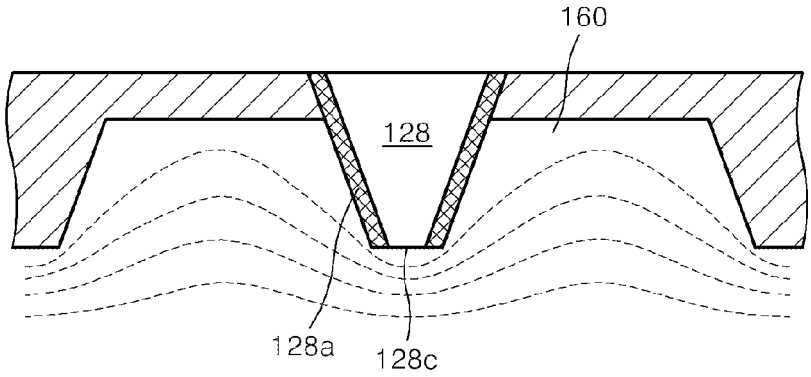
FIG. 5 illustrates equipotential lines around an opening of a nozzle.

As illustrated in FIG. 3, the trenches 160 are disposed in the second (Y) directional side of the nozzle blocks 170 including the tapered nozzles 128. The wall 128*a* is inclined at an acute angle such that the nozzle 128 has a tapered (or pointed) cross-sectional shape in the second (Y) direction. In general, charges tend to concentrate at sharp points. Furthermore, as illustrated in FIG. 5, equipotential lines produced by an electrostatic driving voltage due to the presence of the trenches 160 are concentrated near the opening 128*c* of the nozzle 128. This may create a relatively large electric field around the opening 128*c* of the nozzle 128 so as to increase an electrostatic driving force at the opening 128*c*. Thus, the above configuration may effectively accelerate ink droplets and further reduce the volume of the ink droplets for a given electrostatic driving force. The above configuration also allows stable ejection of ultra-fine ink droplets, which have a volume on the order of several picoliters or several femtoliters, onto the printing medium P.

As described above, because the inkjet printing device according to at least one example embodiment uses both a piezoelectric driving method and an electrostatic driving method, ink may be ejected using a drop-on-demand (DOD) method, thereby allowing easy control of a printing operation. Furthermore, the inkjet printing device according to at least one example embodiment employs the tapered (or pointed) nozzle 128 in which a size of a cross-sectional area thereof in the second (Y) direction is reduced toward the opening 128*c* due to the presence of the trenches 160 disposed on either side of the nozzle block 170 in the second (Y) direction. Use of the tapered (or pointed) nozzles 128 allows ejection of ultra-fine ink droplets and improves directivity of ejected ink droplets, thereby providing high precision printing.

When a printing operation is performed using an inkjet printing device, residual particles (e.g., ink or dirt) may be trapped around the nozzle 128, which may alter the shape or volume of ink droplets being ejected and/or distort a direction in which the ink droplets are ejected. Thus, before ejecting ink through the nozzle 128 and/or periodically after ejecting ink a desired (or alternatively, predetermined) number of times, a wiping operation may be performed to remove the residual particles from the nozzle 128. To achieve this, a wiping member such as a rubber or felt blade, or roller may be used to wipe a lower surface of the nozzle substrate 111 in the first (X) or second (Y) direction.

As the nozzle 128 has a more pointed shape, it is more advantageous to increase an electrostatic driving force. However, the pointed nozzle 128 is more susceptible to damage than a flat nozzle without the trenches 160 due to a frictional force, mechanical shocks, and the like acting thereon during wiping. In the inkjet printing device according to at least one example embodiment, the nozzle 128 is formed in the nozzle block 170 extending in the first (X) direction, and the trenches 160 are formed only in the second (Y) directional side of the nozzle block 170, so that the wall 128*d* is thicker than the wall 128*a*. Furthermore, since the nozzle block 170, in its entirety, extends in the first (X) direction, the nozzle block 170 has relatively high stiffness compared to a case in which the trenches 160 are formed entirely around the nozzle 128. Thus, the possibility of damage to the nozzle 128 during wiping may be reduced.

Figure 6:
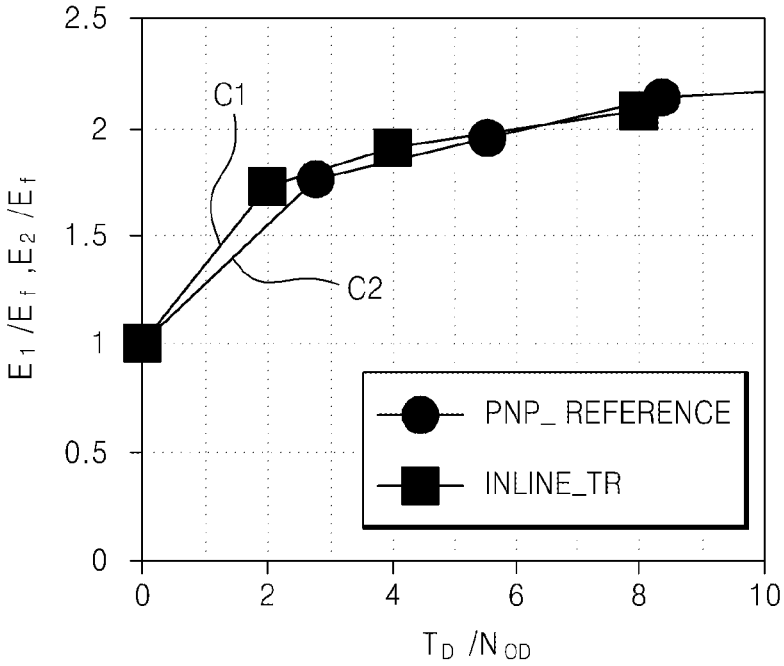
FIG. 6 is a graph illustrating a comparison between an electric field intensity measured when trenches are formed only at either side of a nozzle in a second direction according to at least one example embodiment and an electric field intensity measured when trenches are formed entirely around the nozzle.

FIG. 6 is a graph illustrating a comparison between an electric field intensity measured when the trenches 160 are formed only at either side of the nozzle 128 in the second (Y) direction and electric field intensity measured when the trenches 160 are formed entirely around the nozzle 128. In FIG. 6, a line C1 denotes a ratio $E_1/E_f$ of a maximum electric field intensity $E_1$ measured when the trenches 160 are formed only at either side of the nozzle 128 in the second (Y) direction to an electric field intensity $E_f$ measured at a flat nozzle without the trenches 160. A line C2 denotes a ratio $E_2/E_f$ of a maximum electric field intensity $E_2$ measured when the trenches 160 are formed entirely around the nozzle 128 to an electric field intensity $E_f$ measured at a flat nozzle without the trenches 160. The abscissa denotes a ratio of a depth $T_D$ of the trench 160 to an outside diameter $N_{OD}$ of the nozzle 128.

As is apparent from the graph in FIG. 6, an electric field intensity at the nozzle 128 with the trenches 160 formed therearound is larger than at a flat nozzle without the trenches 160, which means an electrostatic driving force at the pointed nozzle 128 is also greater than that at the flat nozzle. As the depth $T_D$ of the trench 160 increases, an electric field intensity increases. Furthermore, an electric field intensity measured when the trenches 160 are formed only at either side of the nozzle 128 in the second (Y) direction is similar to that measured when the trenches 160 are formed entirely around the nozzle 128. In other words, the performance of a device having the trenches 160 formed only at either side of the nozzle 128 in the second (Y) direction is almost the same as the performance of a device having the trenches 160 formed entirely around the nozzle 128. Thus, the inkjet printing device according to at least one example embodiment provides an increased electrostatic driving force, and also provides improved nozzle stiffness so that the possibility of damage to the nozzle 128 during wiping may be reduced.

Figure 7:
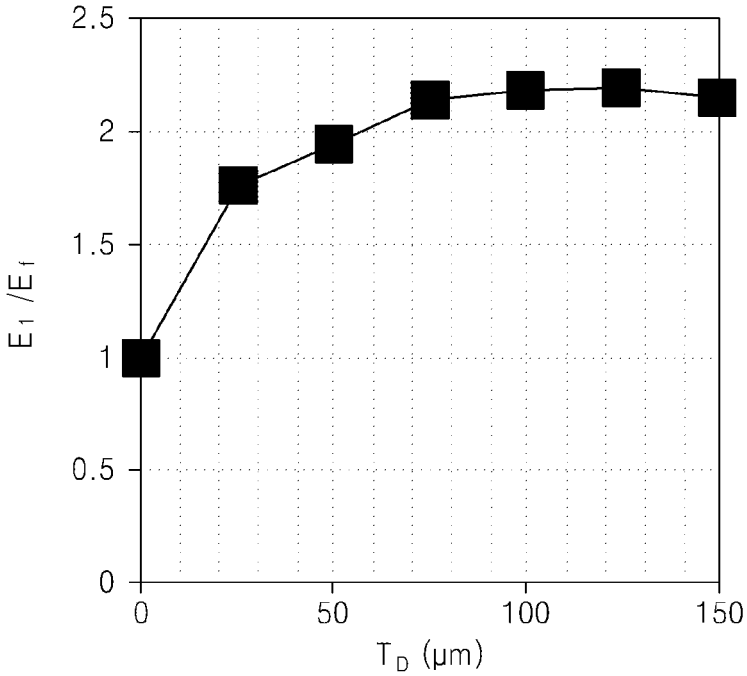
FIG. 7 is a graph of an electric field intensity with respect to a trench depth according to at least one example embodiment.

FIG. 7 is a graph of an electric field intensity with respect to a trench depth $T_D$ according to at least one example embodiment. In FIG. 7, a width of the trench 160 is 600 μm, a thickness of the wall 128*a* is 3 μm, and inside diameter $N_{ID}$ and outside diameter $N_{OD}$ of the nozzle 128 are 3 μm and 9 μm, respectively. The ordinate denotes a ratio $E_1/E_f$ of a maximum electric field intensity $E_1$ measured when the trenches 160 are formed only at either side of the nozzle 128 in the second (Y) direction to an electric field intensity $E_f$ at a flat nozzle without the trenches 160.

Figure 8:
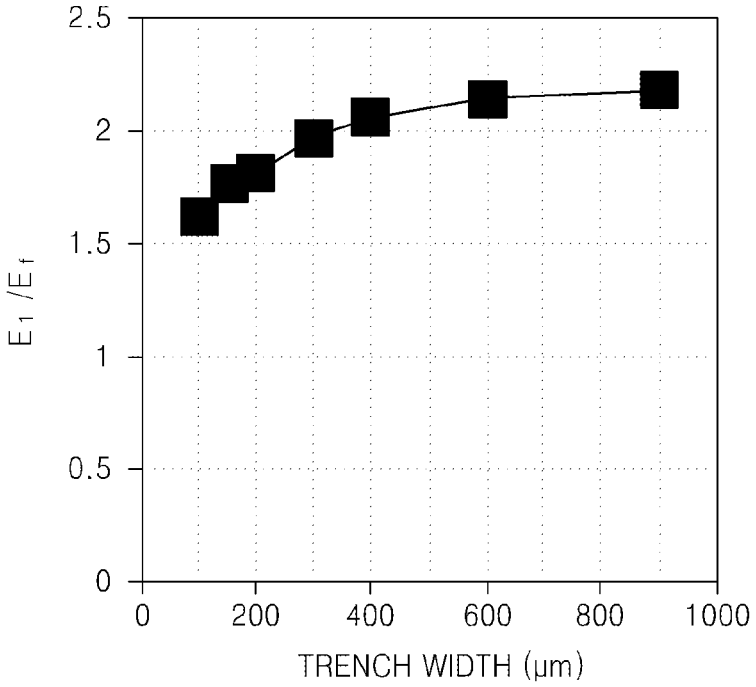
FIG. 8 is a graph of an electric field intensity with respect to a trench width according to at least one example embodiment.

FIG. 8 is a graph illustrating a change in an electric field intensity with respect to a trench width according to at least one example embodiment. In FIG. 8, a depth $T_D$ of the trench is 100 μm, an inside diameter $N_{ID}$ is 3 μm, and a thickness T2 of the wall 128*a* is 3 μm. The ordinate denotes a ratio $E_1/E_f$ of a maximum electric field intensity $E_1$ measured when the trenches 160 are formed only at either side of the nozzle 128 in the second (Y) direction to an electric field intensity $E_f$ at a flat nozzle without the trenches 160. Referring to FIG. 8, as the width of the trench 160 increases under the above-mentioned conditions, an electric field intensity increases. The width of the trench 160 may be appropriately selected by considering a distance between two adjacent nozzles 128.

As the depth $T_D$ of the trench 160 is greater than a given outside diameter $N_{OD}$ of an opening 128*c* of the nozzle 128, equipotential lines are more concentrated around the opening 128*c* of the nozzle 128. By setting the depth $T_D$ of the trench 160 to be greater than the outside diameter $N_{OD}$ of the opening 128*c* of the nozzle 128, an electric field intensity may be increased. Since an electric field intensity is decreased when the depth $T_D$ of the trench 160 is extremely large, an appropriate trench depth $T_D$ may be selected.

In order to form the pointed opening 128*c* of the nozzle 128, the outside diameter $N_{OD}$ of the opening 128*c* should be as small as possible. However, in this case, the inside diameter $N_{ID}$ of the opening 128*c* is reduced, thereby increasing a pressure drop within the nozzle 128. A pressure created in the pressure chamber 125 for ejecting ink is proportional to a magnitude of a piezoelectric driving voltage, and may be determined appropriately so as to compensate for pressure drops and eject the ink at a desired (or alternatively, predetermined) velocity. Since the inside diameter $N_{ID}$ of the opening 128*c* is decreased in order to eject fine ink droplets, with an increasing pressure drop, a relatively large load is applied to the piezoelectric actuator 130. In order to maintain the pressure drop below an appropriate level so that an excessive load is not applied to the piezoelectric actuator 130, a ratio of the outside diameter $N_{OD}$ to the inside diameter $N_{ID}$ may be less than about 5.

Figure 9:
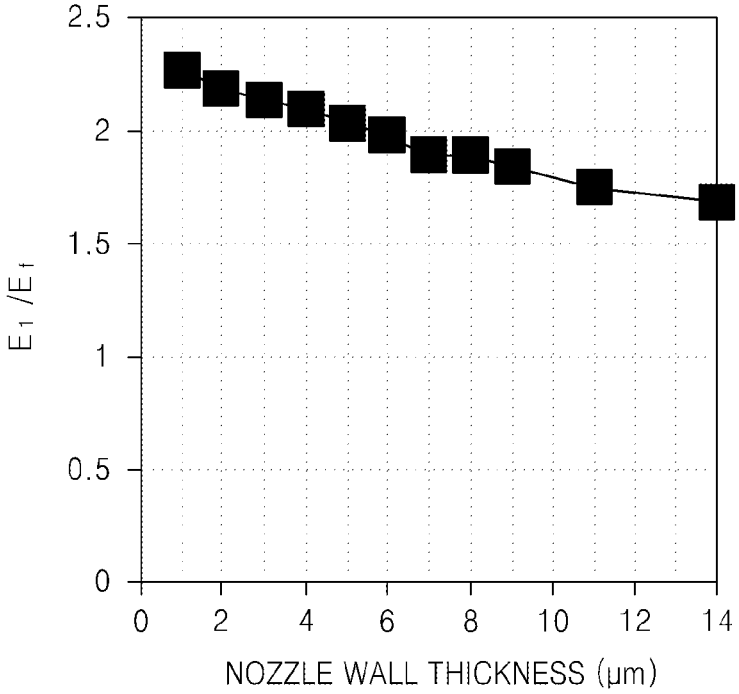
FIG. 9 is a graph of an electric field intensity with respect to a nozzle wall thickness according to at least one example embodiment.

As the thickness T2 of the wall 128*a* of the nozzle 128 becomes smaller, the nozzle 128 has a more pointed shape. FIG. 9 is a graph illustrating a change in electric field intensity with respect to the thickness T2 of the wall 128*a* of the nozzle 128 according to at least one example embodiment. In FIG. 9, a width of the trench 160 is 600 μm, a depth $T_D$ of the trench is 100 μm, and an inside diameter $N_{ID}$ of the nozzle 128 is 3 μm. The ordinate denotes a ratio $E_1/E_f$ of a maximum electric field intensity $E_1$ measured when the trenches 160 are formed only at either side of the nozzle 128 in the second (Y) direction to an electric field intensity $E_f$ at a flat nozzle without the trenches 160. As apparent from the graph in FIG. 9, as the thickness T2 of the wall 128*a* decreases under the above given conditions, the electric field intensity increases.

The shape of the nozzle 128 may be determined so as to minimize a pressure drop within the nozzle 128. When the nozzle 128 is completely tapered in the direction from its entrance towards the opening 128*c*, a relatively small pressure drop occurs in the nozzle 128. However, because of manufacturing errors, a non-tapered portion may form near the opening 128*c* of the nozzle 128. By making a length of the non-tapered portion less than the inside diameter $N_{ID}$ of the nozzle 128, it is possible to mitigate (or alternatively, prevent) an excessive increase in piezoelectric driving voltage.

A method of forming the nozzle 128 according to at least one example embodiment will now be described in detail with reference to FIGS. 10A through 10M.

Figure 10A:
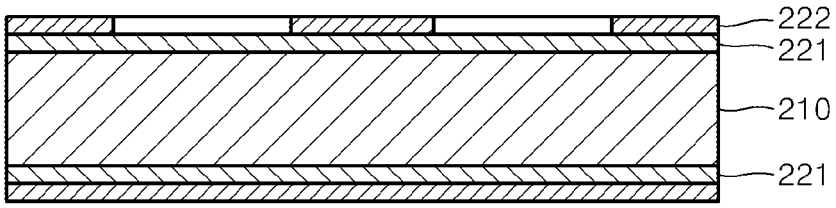
FIGS. 10A through 10M illustrate a method of forming a tapered nozzle shown in FIG. 2 according to at least one example embodiment.
Figure 10B:
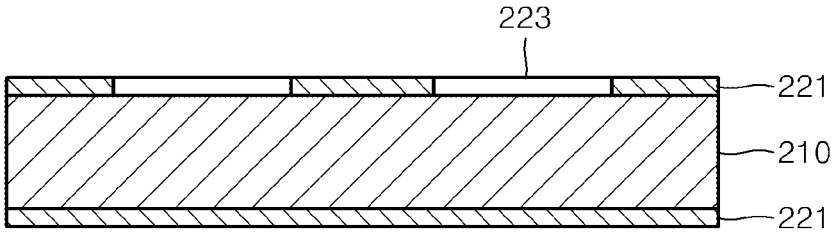

An etch mask is formed on one surface of a substrate 210. For example, referring to FIG. 10A, the single crystal silicon substrate 210 having a top surface with a <100> crystal orientation is prepared, and then the mask layer 221 is formed. For example, the mask layer 221 may be a $SiO_2$ layer. The $SiO_2$ layer may be formed by oxidizing the single crystal silicon substrate 210. The $SiO_2$ layer has a thickness in the range of about 100 Å to about 4000 Å. Thereafter, a photoresist layer 222 is formed on the mask layer 221. The photoresist layer 222 is patterned using a lithographic method or other patterning techniques to expose a portion of the mask layer 221. Referring to FIG. 10B, the mask layer 221 is then patterned using the photoresist layer 222 as a mask, thereby exposing a portion 223 where the nozzles 128 are to be formed. The mask layer 221 may be patterned by using a wet etching process with a buffered hydrogen fluoride (BHF) acid.

Figure 10C:
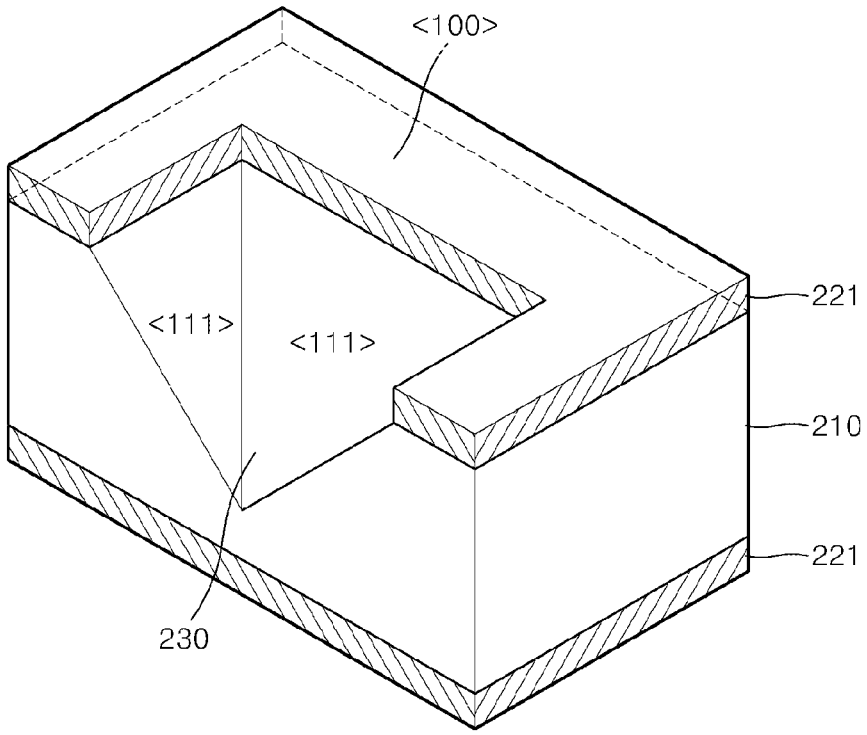
Figure 10D:
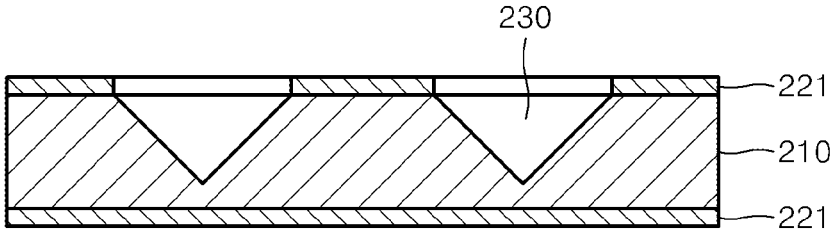
Figure 10E:
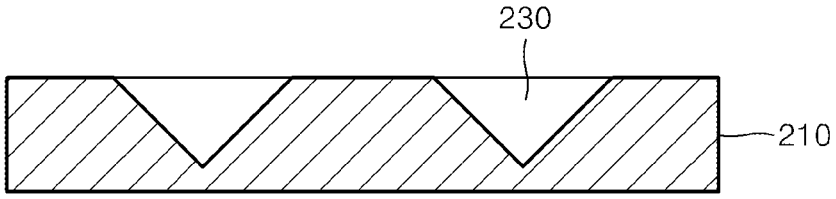
Figure 10F:
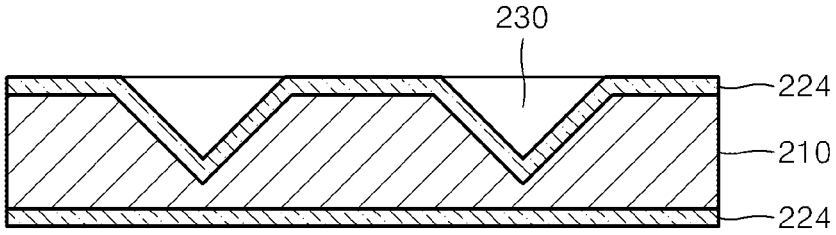
Figure 10G:
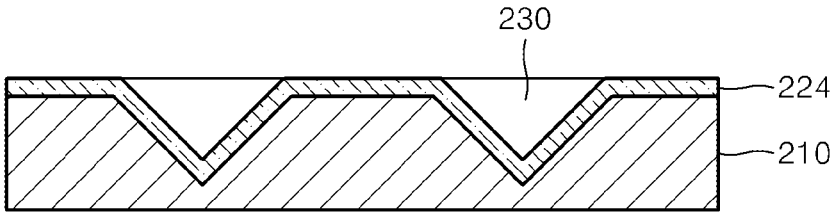

Using the mask layer 221 as an etch mask, the substrate 210 is etched. For example, the substrate 210 may be anisotropically etched by using Tetramethyl ammonium hydroxide (TMAH). Referring to FIG. 10C, the top surface of the substrate 210 has the <100> crystal orientation while a surface being etched has a <111> crystal orientation. Due to a difference in etching rate between the <100> and <111> orientations, relatively fast etching is performed downward while relatively slow etching is performed sideward, as illustrated in FIGS. 10C and 10D. Due to the difference in etch rate, a recessed region 230 is formed in the substrate 233 to have a tapered shape in which a cross-sectional area thereof decreases downward. The recessed region 230 may have a polypyramid or cone shape depending on the shape of the exposed portion 223 and the type and conditions of the etching process. According to at least one example embodiment, the exposed portion 223 of the mask layer 221 has a quadrangular shape, so the recessed region 230 has a quadrangular pyramid shape. When anisotropic wet etching is performed, the recessed region 230 may still be formed in the shape of a quadrangular pyramid even when the exposed portion 223 is circular. The recessed region 230 does not penetrate a bottom surface of the substrate 210.

Figure 10H:
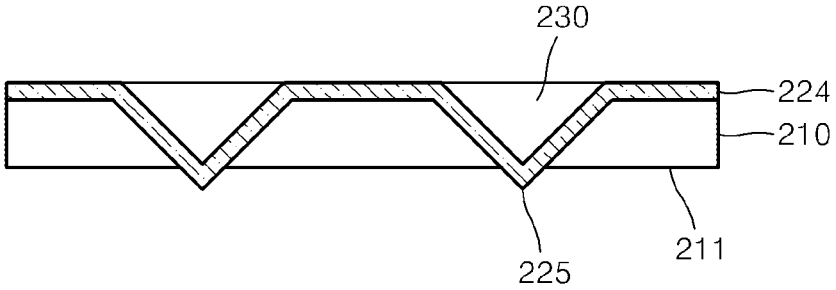
Figure 10I:
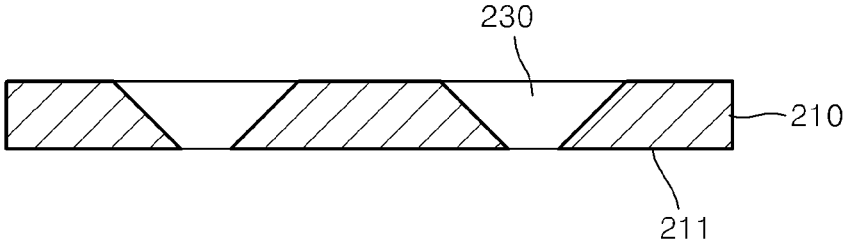
Figure 10J:
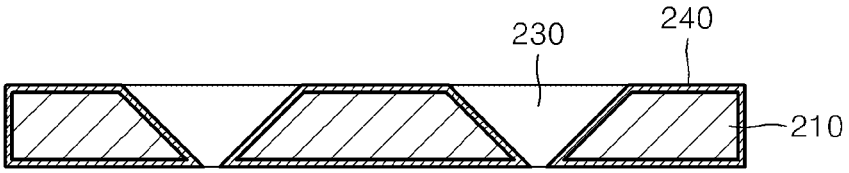
Figure 10K:
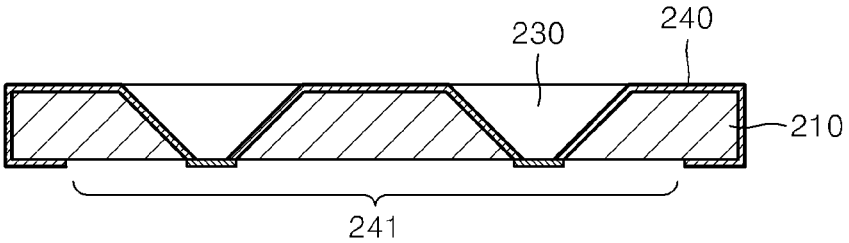

During a subsequent process, the recessed portion 230 may penetrate to the bottom surface of the substrate 210. More specifically, referring to FIG. 10E, the mask layer 221 formed on the top and bottom surfaces of the substrate 210 are removed by etching, polishing, or other techniques. Thereafter, referring to FIG. 10I, the bottom surface of the substrate 210 may be polished so that the recessed region 230 penetrates the bottom surface of the substrate 210. Alternatively, referring to FIG. 10F, a protective layer 224 is formed at least on the top surface of the substrate 210 and wall surfaces of the recessed region 230. For example, the protective layer 210 may be a $SiO_2$ layer obtained by oxidizing the substrate 210. The protective layer 210 may have a thickness in the range of about 100 Å to about 10000 Å. Since the protective layer 224 may be spontaneously and unnecessarily formed on the bottom surface of the substrate 210 during an oxidation process, the protective layer 224 on the bottom surface of the substrate 210 is not necessarily required. Next, referring to FIG. 10G, the substrate 210 is removed from the bottom surface by a desired (or alternatively, predetermined) thickness. Referring to FIG. 10H, the substrate 210 is etched upward from the bottom surface so that a bottom surface 211 obtained by the etching process is located at least higher than a pointed tip 225 of the protective layer 224 in the recessed region 230. The protective layer 224 protects the recessed region 230 from an etching material during the etching process. Referring to FIG. 101, the protective layer 224 is then removed so that the recessed region 230 penetrates the bottom surface 211 of the substrate 210.

Figure 10L:
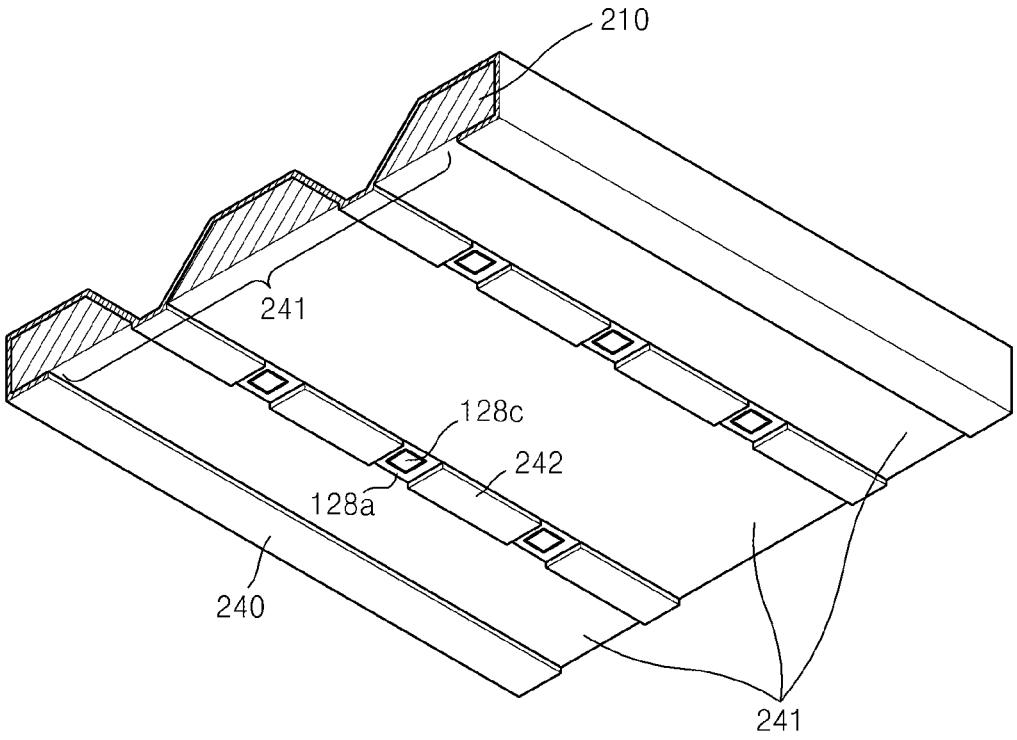
Figure 10M:
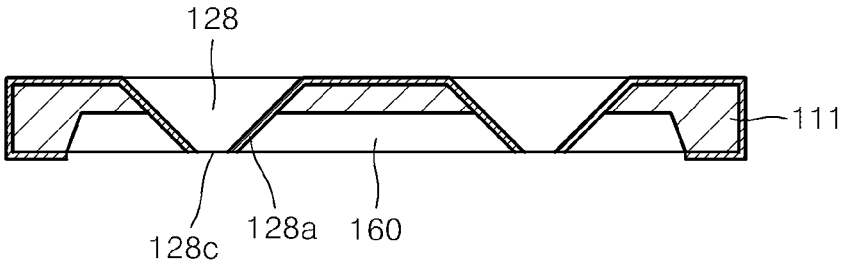

Subsequently, a wall 128*a* and a trench 160 are formed. More specifically, first, referring to FIG. 10J, a wall forming material layer 240 is formed on the top and bottom surface of the substrate 210 and the wall of the recessed region 230. For example, the wall forming material layer 240 may be a $SiO_2$ layer obtained by oxidizing the single crystal silicon substrate 210. Alternatively, the wall forming material layer 240 may be formed by coating, applying, or depositing SiN, Ti, Pt, or Ni. The wall forming material layer 240 may have a thickness in the range of about 100 Å to about 10000 Å. Next, referring to FIG. 10K, a portion of the wall forming material layer 240 formed on the bottom surface of the substrate 210 is removed to define a region 241 for forming the trench 160. FIG. 10L is a bottom perspective view of FIG. 10K. Referring to FIG. 10L, the region 241 is a region excluding a portion 242 for forming a nozzle block 170. The process for defining the region 241 includes coating photoresist on the wall forming material layer 240, patterning the photoresist to expose a portion of the wall forming material layer 240 corresponding to the region 241, and etching the wall forming material layer 240 by using the patterned photoresist as a mask. Thereafter, a portion of the substrate 210 corresponding to the region 241 is etched using the remaining portion of the wall forming material layer 240 as an etch mask so as to form the trench 160. Then, when desired, the wall forming material layer 240 formed at the portion 242 is removed. Referring to FIGS. 10L and 10M, the wall forming material layer 240 formed on the wall of the recessed region 230 forms the wall 128*a*, and an opening 128*c* extends into the trench 160 toward a bottom surface of the substrate 210. The opening 128*c* may be at the same level as the bottom surface 111*a* as illustrated in FIG. 3 or between top and bottom surfaces 111*c* and 111*a*, or protrude from the bottom surface 111*a*.

Using the above-mentioned process, the nozzle substrate 111 shown in FIGS. 1 through 4 may be fabricated.

The inkjet printing device according to at least one example embodiment may be driven in a plurality of driving modes in which ink droplets may be ejected in different sizes and shapes by controlling the order of applying an piezoelectric driving voltage and an electrostatic driving voltage to the piezoelectric actuator 130 and the electrostatic actuator 140, respectively. In at least one example embodiment, driving the inkjet printing device may also include controlling the magnitudes and durations of the applied piezoelectric driving voltage and electrostatic driving voltage. For example, the plurality of driving modes may include a dripping mode in which fine droplets having a smaller size than a size of the nozzle 128 are ejected, a cone-jet mode in which fine droplets that are smaller than droplets ejected in the dripping mode are ejected, and a spray mode in which ink droplets are ejected as jet streams.

According to the dripping mode, fine ink droplets, which are smaller than the size of a nozzle, may be ejected. For example, ultra-fine ink droplets having a volume of the order of several picoliters or several femtoliters may be ejected through a nozzle having a diameter of several micrometers to several tens of micrometers. In the dripping mode, a nozzle having a relatively large diameter may be used while ejecting fine droplets, and thus, the possibility of nozzle clogging is reduced and the reliability is enhanced.

According to the cone-jet mode, finer ink droplets may be ejected than in the dripping mode. The dripping mode and the cone-jet mode are affected by the electrical conductivity and the viscosity of ink. For example, when ink having a relatively high electrical conductivity and a relatively low viscosity is used, a speed of charges traveling toward a surface of the ink is relatively increased, and ink droplets are easily separated from a dome-shaped meniscus before a Taylor cone-shaped meniscus is formed. Thus, use of the dripping mode facilitates ejection of ink droplets. On the other hand, when ink having a relatively low electrical conductivity but a relatively high viscosity is used, a speed of charges toward a surface of ink is decreased, and a Taylor cone-shaped meniscus may be easily created. Thus, in this case, use of the cone-jet mode allows ejection of finer ink droplets. Accordingly, the above two driving modes may be used appropriately according to the characteristics of the ink. In order to more easily create a Taylor cone-shaped meniscus in the cone-jet mode, a piezoelectric driving voltage may be maintained at a low level so that an electrostatic force that pulls the ink outward the nozzle 128 is greater than a pressure that pushes the ink outward the nozzle 128.

According to the spray mode, the ink may be extended as a stream to create a printing pattern formed of a plurality of solid lines on a printing medium P. The ink stream may be dispersed to form a printing pattern that is coated using a spraying method on the printing medium P.

While hybrid type inkjet printing devices using both a piezoelectric driving method and an electrostatic driving method according to example embodiments have been particularly shown and described, it should be understood by those of ordinary skill in the art that example embodiments described above should be considered in a descriptive sense only and not for purposes of limitation. The structures of nozzles and trenches and the method of forming the nozzles and the trenches described above should be considered as available for printing devices using only a piezoelectric driving method or only an electrostatic driving method for ejecting fine droplets.

What is claimed is:

1. An inkjet printing device comprising:

a passage forming substrate having a plurality of pressure chambers; and a nozzle substrate including, a plurality of nozzle blocks extending in a first direction, a plurality of nozzles connected to the pressure chambers and penetrating the nozzle blocks, and a plurality of trenches, recessed from a bottom surface of the nozzle blocks, each of the trenches extending in the first direction and being disposed in a second direction perpendicular to the first direction with respect to the nozzle blocks, wherein the nozzle substrate is a single crystal silicon (Si) substrate, wherein a wall of each of the nozzles in the second direction is formed of silicon dioxide ($SiO_2$), and wherein a wall of each of the nozzles in the first direction is formed of a $SiO_2$-Si hybrid material.

2. The device of claim 1, wherein the nozzles have a tapered shape such that a cross-sectional area of the nozzles decreases from a top surface of the nozzle substrate toward a bottom surface of the nozzle substrate.

3. The device of claim 2, wherein a wall of each of the nozzles in the first direction is inclined at an acute angle with respect to a direction along which the nozzles penetrates the nozzle blocks.

4. The device of claim 2, wherein the nozzles have one of a polypyramid shape and a cone shape.

5. The device of claim 4, wherein the nozzles have a quadrangular pyramid shape.

6. The device of claim 1, further comprising:

a piezoelectric actuator configured to provide a pressure change for ejecting ink within the pressure chamber; and an electrostatic actuator configured to provide an electrostatic driving force to ink within the nozzle.

7. An inkjet printing device comprising:

a passage forming substrate having a plurality of pressure chambers;

a nozzle substrate including a plurality of nozzles, each of the nozzles having an opening through which ink within the pressure chamber is ejected; and an actuator configured to provide a driving force for ejecting ink through the nozzles, wherein a wall of each of the nozzles in a first direction is thicker than a wall of each of the nozzles in a second direction perpendicular to the first direction.

8. The device of claim 7, wherein the nozzle substrate includes, a plurality of nozzle blocks, each nozzle block extending in the first direction and including the plurality of nozzles, and a plurality of trenches, each trench being disposed in the second direction perpendicular to the first direction with respect to the nozzle blocks and recessed from a bottom surface of the nozzle blocks.

9. The device of claim 8, wherein the nozzle blocks include the plurality of nozzles arranged in the first direction.

10. The device of claim 8, wherein the wall of each of the nozzles in the first direction forms a boundary between the nozzle blocks and the trenches.

11. The device of claim 10, wherein the nozzles have a tapered shape such that a cross-sectional area of the nozzles decreases from a top surface of the nozzle blocks toward the bottom surface of the nozzle blocks.

12. The device of claim 11, wherein the wall of each of the nozzles in the first direction is inclined at an acute angle with respect to a direction along which the nozzles penetrate the nozzle blocks.

13. The device of claim 12, wherein the nozzles have one of a polypyramid shape and a cone shape.

14. The device of claim 13, wherein the nozzles have a quadrangular pyramid shape.

15. The device of claim 7, wherein the actuator includes an electrostatic actuator configured to provide an electrostatic driving force to ink within the nozzles.

16. The device of claim 15, wherein the actuator further includes a piezoelectric actuator configured to provide a pressure change for ejecting the ink within the pressure chamber.

17. An inkjet printing device comprising:

a passage forming substrate having a plurality of pressure chamber; and a nozzle substrate including, a plurality of nozzle blocks extending in a first direction, a plurality of nozzles connected to the pressure chambers and penetrating the nozzle blocks, and a plurality of trenches recessed from a bottom surface of the nozzle blocks, each of the trenches extending in the first direction and being disposed in a second direction perpendicular to the first direction with respect to the nozzle blocks, wherein the nozzles have a tapered shape such that a cross-sectional area of the nozzles decreases from a top surface of the nozzle substrate toward a bottom surface of the nozzle substrate, and wherein an outer diameter and an inner diameter of an outlet of the nozzle are $N_{OD}$ and $N_{ID}$, respectively, and a ratio to $N_{OD}$ to $N_{ID}$ is less than 5.

* * * * *